US008099895B2

(12) United States Patent
Farley, Jr. et al.

(10) Patent No.: US 8,099,895 B2
(45) Date of Patent: Jan. 24, 2012

(54) KINETIC FIREARM TRIGGER

(76) Inventors: James Shelton Farley, Jr., Oklahoma City, OK (US); James Shelton Farley, Jr. III, Oklahoma City, OK (US)

( * ) Notice: Subject to any disclaimer, the term of this patent is extended or adjusted under 35 U.S.C. 154(b) by 87 days.

(21) Appl. No.: 12/684,713

(22) Filed: Jan. 8, 2010

(65) Prior Publication Data

US 2010/0175291 A1 Jul. 15, 2010

Related U.S. Application Data

(60) Provisional application No. 61/204,963, filed on Jan. 13, 2009.

(51) Int. Cl.
*F41A 19/10* (2006.01)

(52) U.S. Cl. ..... 42/69.03; 42/69.02; 89/136

(58) Field of Classification Search ..... 42/69.01–69.03, 42/DIG. 1; 89/136, 27.11; 124/31
See application file for complete search history.

(56) References Cited

U.S. PATENT DOCUMENTS

| | | | | | |
|---|---|---|---|---|---|
| 2,249,231 | A | | 4/1937 | Smith | |
| 2,136,511 | A | | 10/1937 | Jones | |
| 2,249,232 | A | | 2/1939 | Smith | |
| 2,556,025 | A | * | 6/1951 | Canjar | 42/69.02 |
| 2,856,717 | A | * | 10/1958 | Parke | 42/69.02 |
| 3,707,796 | A | | 1/1973 | Bielfeldt | |
| 4,625,444 | A | * | 12/1986 | Beretta | 42/69.02 |
| 4,671,005 | A | | 6/1987 | Jewell | |
| 5,363,581 | A | * | 11/1994 | Blenk et al. | 42/69.02 |
| 5,487,233 | A | | 1/1996 | Jewell | |
| 5,718,074 | A | * | 2/1998 | Keeney | 42/69.03 |
| 5,797,206 | A | | 8/1998 | Vitorino | |
| 5,852,891 | A | | 12/1998 | Onishi et al. | |
| 6,308,448 | B1 | | 10/2001 | Kapusta et al. | |
| 6,820,606 | B1 | | 11/2004 | Duffey | |
| 6,978,568 | B2 | * | 12/2005 | Jewell | 42/69.02 |
| 7,188,561 | B1 | | 3/2007 | Kelbly | |
| 7,421,937 | B1 | | 9/2008 | Gangl | |
| 2005/0188580 | A1 | * | 9/2005 | Jewell | 42/69.02 |
| 2006/0123685 | A1 | * | 6/2006 | Zeh | 42/69.02 |

FOREIGN PATENT DOCUMENTS

EP 534522 A1 * 3/1993

* cited by examiner

*Primary Examiner* — Michael Carone
*Assistant Examiner* — Jonathan C Weber
(74) *Attorney, Agent, or Firm* — Robert H. Frantz

(57) ABSTRACT

A trigger mechanism having a sear block engaging a striker of a firearm, a pivot drop piece supporting the sear block in an over center configuration, a toggle sear supporting the pivot drop piece and engaging a finger piece via a set of sear surfaces, the toggle sear having a toggle sear fly weight, such that when pressure is applied to the finger piece to overcome the sear surfaces friction, the finger piece releases the toggle sear, the pivot piece collapses and allows the sear block to release the cocking piece or striker, wherein during the collapsing motions, movement of the toggle sear is initially damped by kinetic resistance of the fly weight, and later, completion of the collapsing motions are assisted by inertia stored in the fly weight, providing full disengagement of the sear block from the striker.

13 Claims, 8 Drawing Sheets

KINETIC FIREARM TRIGGER

CROSS-REFERENCE TO RELATED APPLICATIONS

This patent application claims benefit of U.S. provisional patent application Ser. No. 61/204,963, filed on Jan. 13, 2009, by James Shelton Farley Jr., et al.

FEDERALLY SPONSORED RESEARCH AND DEVELOPMENT STATEMENT

Not applicable.

MICROFICHE APPENDIX

Not applicable.

INCORPORATION BY REFERENCE

The related U.S. provisional patent application Ser. No. 61/204,963, filed on Jan. 13, 2009, by James Shelton Farley Jr., et al., is hereby incorporated by reference in its entirety.

BACKGROUND OF THE INVENTION

1. Field of the Invention

This patent application claims benefit of U.S. provisional patent application Ser. No. 61/204,963, filed on Jan. 13, 2009, by James Shelton Farley Jr., et al. This invention relates to the arts of trigger mechanisms for firearms and the like.

2. Background of the Invention

Rifle triggers have been produced over many years for different various shooting applications. The objective of triggers designed for competitive shooting has always been to achieve a light pull at the finger piece to actuate the trigger mechanism. By "light pull", those in the art mean a low weight of pressure required to release the trigger. Typically, a trigger is considered to have a light pull if it's release pressure is in the few ounces to one or two pounds range. Conversely, a "heavy pull" would be a release pressure of several pounds.

We believe that the Jewell trigger described in U.S. Pat. No. 4,671,005 was likely the first of its kind to employ "over center" internal geometry specifically to this end. Those skilled in the art realize that light pressure applied to the finger piece to collapse the trigger mechanism is a direct result of trigger geometry that allows for light pressure where sear surfaces are engaged.

Other very popular triggers are the Canjar trigger and Shilen trigger. Most of these triggers are available for use in Mauser-type, bolt-action, Remington 700 and 40× rifle actions. There are many other triggers made by other manufacturers, but most have a high degree of resemblance to the Jewell, Canjar or Shilen trigger.

However, some problems with existing trigger designs are that they:

(a) continue to make contact with the firing pin assembly once released, resulting in firing pin misalignment and loss of rifle accuracy;

(b) sometimes have difficulty resetting, which seriously affects reliability;

(c) require a number of different fasteners and other hardware making them more costly to manufacture and assemble;

(d) are susceptible to contaminants which adversely affects reliability; and (e) can be difficult to consistently set the sear engagement surfaces, also affecting reliability.

SUMMARY OF THE INVENTION

A trigger mechanism having a sear block engaging a striker of a firearm, a pivot drop piece supporting the sear block in an over center configuration, a toggle sear supporting the pivot drop piece and engaging a finger piece via a set of sear surfaces, the toggle sear having a fly weight, such that when pressure is applied to the finger piece to overcome the sear surfaces friction, the finger piece releases the toggle sear, the pivot piece collapses and allows the sear block to release the cocking piece or striker, wherein during the collapsing motions, movement of the toggle sear is initially damped by kinetic resistance of the fly weight, and later, completion of the collapsing motions are assisted by inertia stored in the fly weight, providing full disengagement of the sear block from the striker.

Other features, enhancements, and alternative embodiment options will be disclosed in the following paragraphs.

BRIEF DESCRIPTION OF THE DRAWINGS

The following detailed description when taken in conjunction with the figures presented herein provide a complete disclosure of the invention.

DESCRIPTION OF THE INVENTION

Figure 1:
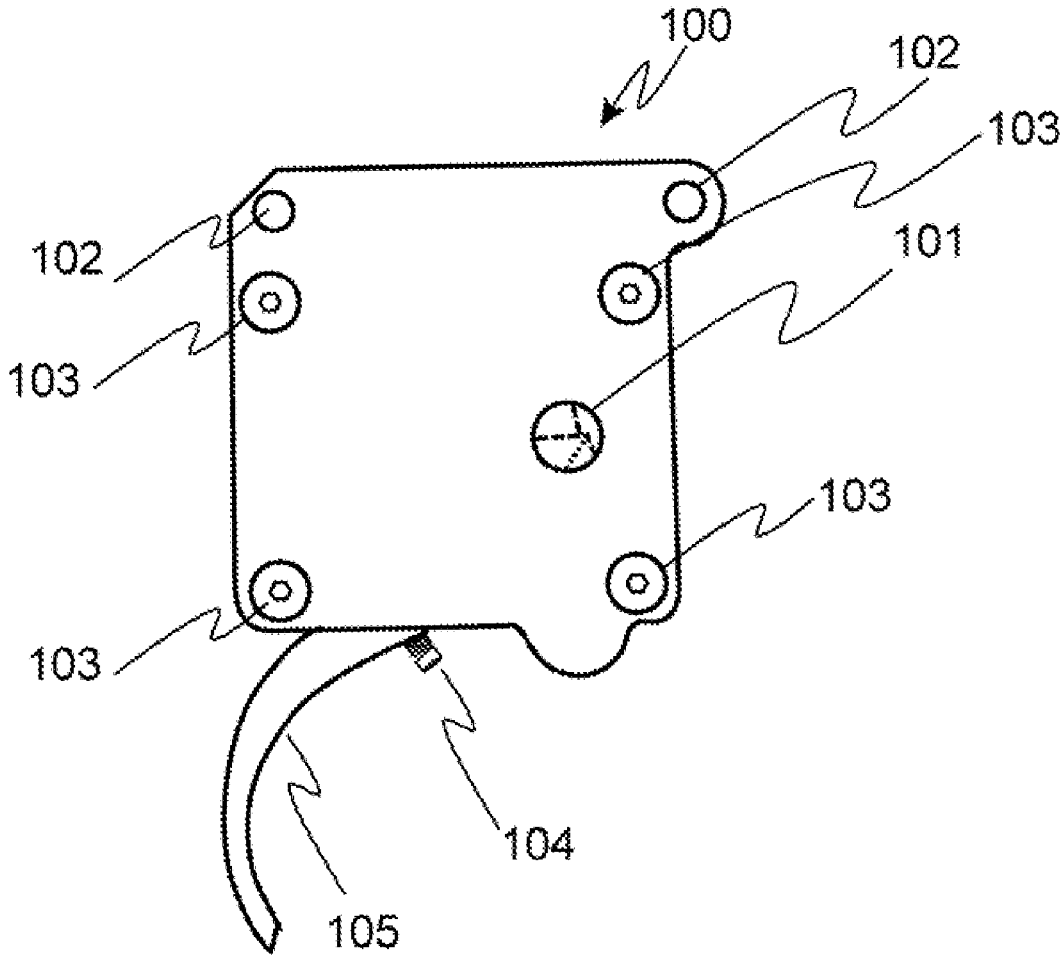
FIG. 1 shows a completely assembled trigger mechanism with the top cover installed over the cavity frame with internal components, with an extending finger piece.

We have created a new type of trigger for use in rifle shooting which we refer to as the "Kinetic Trigger" which employs a pivot drop piece to engage a single lever which is then controlled by a finger piece to allow for collapse of the trigger mechanism. During collapse, the inertia of the lever overcomes the trigger main spring for an instant allowing for the firing pin assembly to move forward untouched by the trigger sear block. This inertial effect may reduce or eliminate portions of the trigger rebounding into the cocking piece during firing movement. When trigger reset is allowed to take place, the inertia from the same lever moving in the opposite direction aids in trigger reset by contacting a reset feature built into the finger piece in effect forcing the finger piece to reset.

Our new Kinetic Trigger employs a unique "over center" internal geometry incorporating a kinetic energy storage and resistance element, which not only achieves low release pressure where sear surfaces are engaged, but allows for integral structures for both kinetic resistance and reliable finger piece reset. In one available embodiment, certain traditionally employed internal structures are reduced, minimized, or eliminated through the use of innovative elements that allow for easier setting for sear surface engagement, reduces contaminant infiltration, decreases assembly time, reduces component count, and increases reliability and serviceability.

The Kinetic Trigger is preferable to other triggers for several reasons:

(a) The geometry of the trigger mechanism allows for an integral kinetic structure to eliminate possible rebounding during mechanism collapse, thereby eliminating firing pin interference during advance, which increases accuracy of a shot placed with a rifle employing the Kinetic Trigger.

(b) The geometry of the Kinetic Trigger mechanism incorporates a reset feature on the finger piece which transmits the return energy of the mechanism to force reset, thereby increasing the reliability of the operation of the trigger assembly as compared to traditional competition, light-pull triggers.

(c) The Kinetic Trigger is, in one embodiment, comprised of a single frame cavity construction, incorporating captive pivots for all hinge points, resulting in elimination of standoff hardware and additional fasteners, thereby providing a less expensive, more efficient, more reliable design.

(d) The Kinetic trigger's aforementioned a single frame cavity construction with a single attached cover plate reduces seams and openings through which contaminants may enter the internal assembly. The cavity construction provides continuous material from a back plate around and to each side wall, which such that the internal assembly is shielded on all sides from contaminants, thereby increasing reliability and providing improved performance.

(e) The Kinetic Trigger, in at least one embodiment, employs sealed windows machined through both the top cover plate and the frame back wall allowing viewing and setting the sear engagement surfaces.

Environment of Use

Figure 7:
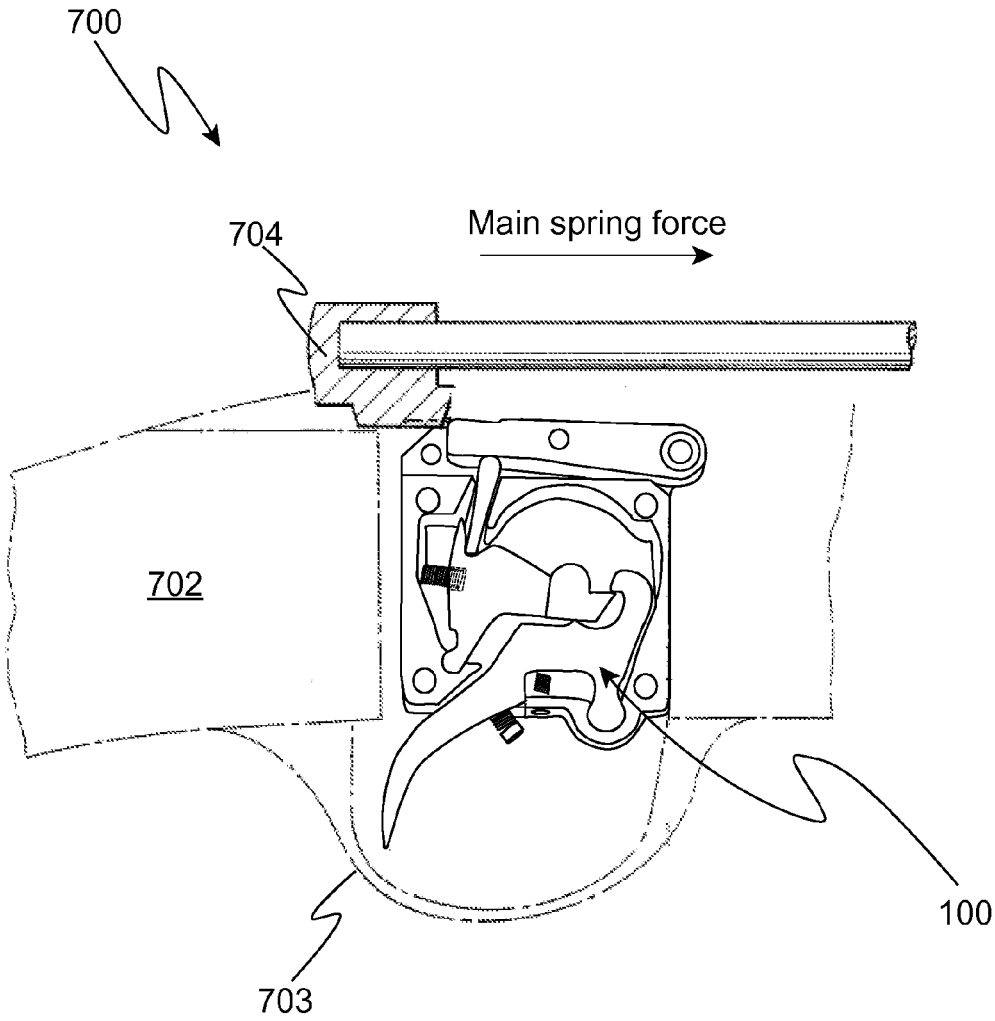
FIG. 7 illustrates a Kinetic Trigger as mounted in a Mauser-type bolt-action rifle.

As shown in FIG. 7, the Kinetic Trigger is particularly well suited for use in a Mauser-type bolt-action rifle (700), or similar rifle actions. The trigger assembly (100) is received in a cavity within the receiver of the rifle (702), with a trigger finger piece protruding below the rifle into an area surrounded by a trigger guard (703). A sear block portion of the trigger assembly engages a striker or cocking piece (704) of the rifle, which is being driven forward by a loaded main spring (not shown) of the rifle. Mounting of the trigger assembly into the rifle is accomplished using conventional, well known means, such as four bolts and/or nuts.

Main Trigger Assembly

Turning to FIG. 1, the trigger mechanism (100) in a fully assembled arrangement has a sealed window aperture 101 to allow a user to view and set sear engagement surfaces (shown in dotted lines). The trigger finger piece (105) and an adjustment screw (104) will be described in more detail in the following paragraphs. The assembled trigger mechanism (100) has a plurality of fasteners (103), such as counter-sunk machine screws, which affix the front cover to the cavity frame. Mounting holes (102) are provided to allow installation of the trigger into a rifle action's receiver.

Figure 3:
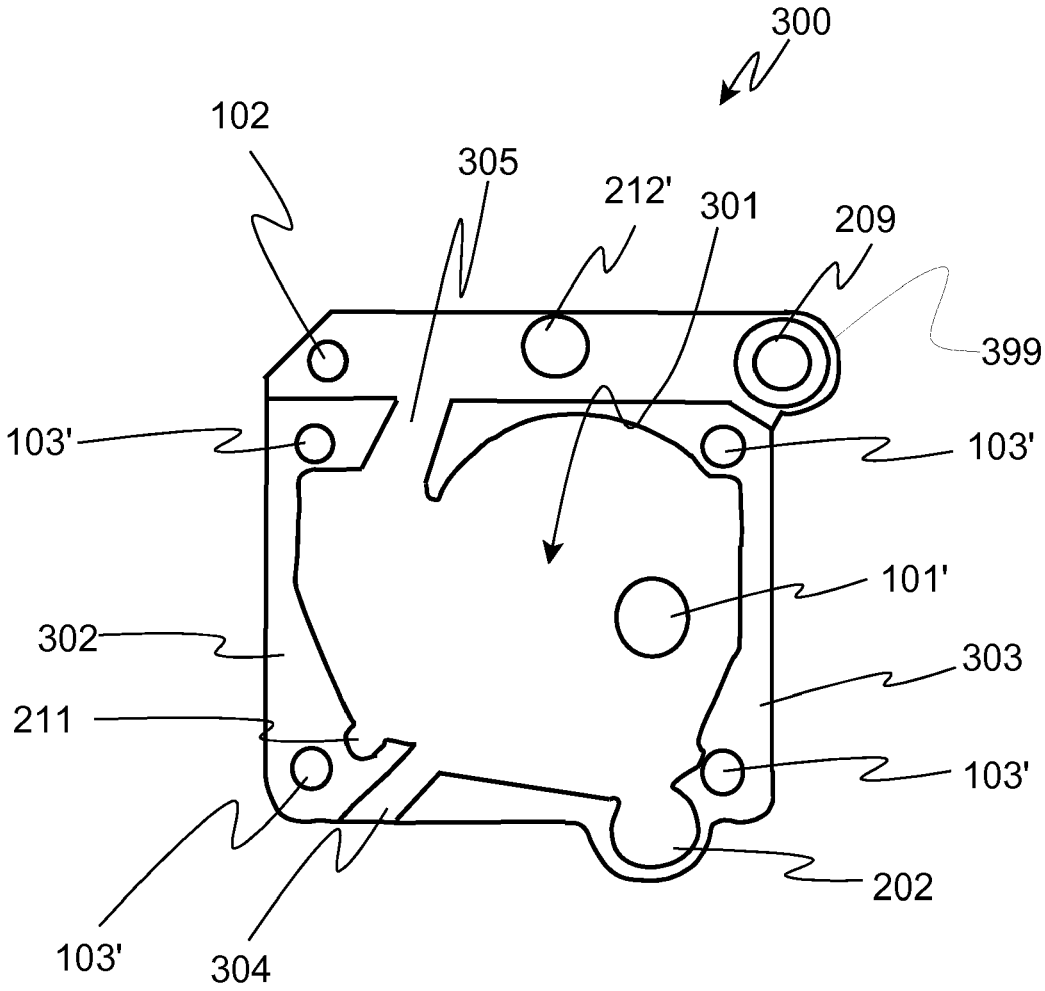
FIG. 3 provides a view of the frame itself, without installed internal components, providing an illustration of the integral features of some embodiments such as the sear window and the captive pivots.

Turning to FIG. 3, the frame (300) provides a cavity (301) formed between a left wall (302), and a top/right/bottom wall (303), with a lower orifice (304) from which the trigger finger piece may protrude (not shown in this diagram), and an upper orifice (305) through which a pivot drop piece (not shown) may protrude to retain the rifle in a cocked position. The frame (300) also preferably provides a solid rear wall forming a back to the cavity, in which a second sealed aperture window (101') is preferably provided for viewing and setting sear engagement surfaces. Captive pivots (202 and 211) will be described in more detail in the following paragraphs. This frame houses all internal components, and contains integral means for their location and control of their movement. The frame also provides an attachment means (103') for the cover plate, such as four tapped holes, essentially aligned with the holes (103) in the front cover. Other attachment means, such as rivets, may be alternatively used in some embodiments.

Figure 2:
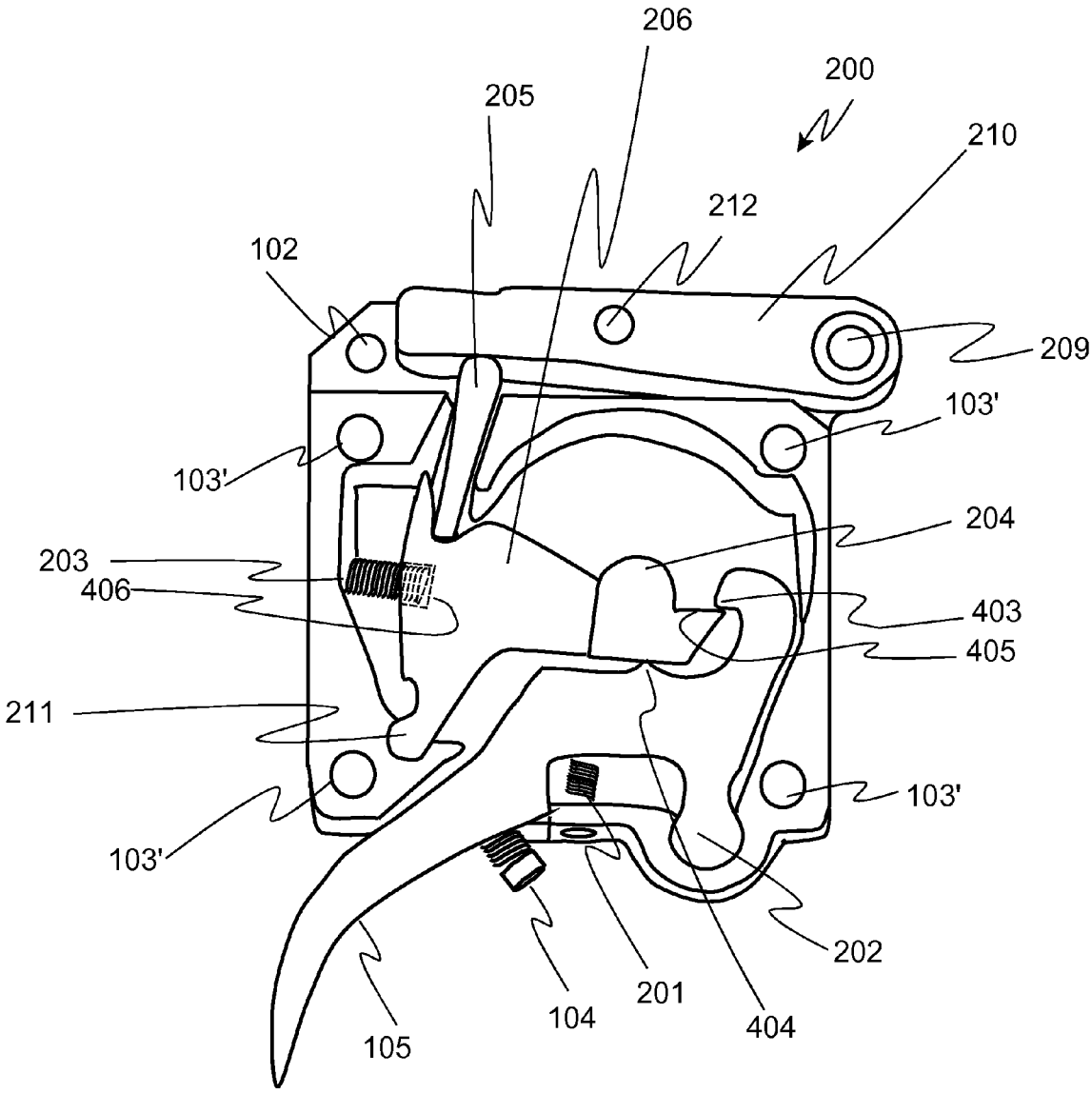
FIG. 2 provides an uncovered view (top cover plate removed) otherwise similar to FIG. 1, providing a view of the internal components in an assembled arrangement, the particular mode depicted being set (e.g. rifle would be cocked).
Figure 4:
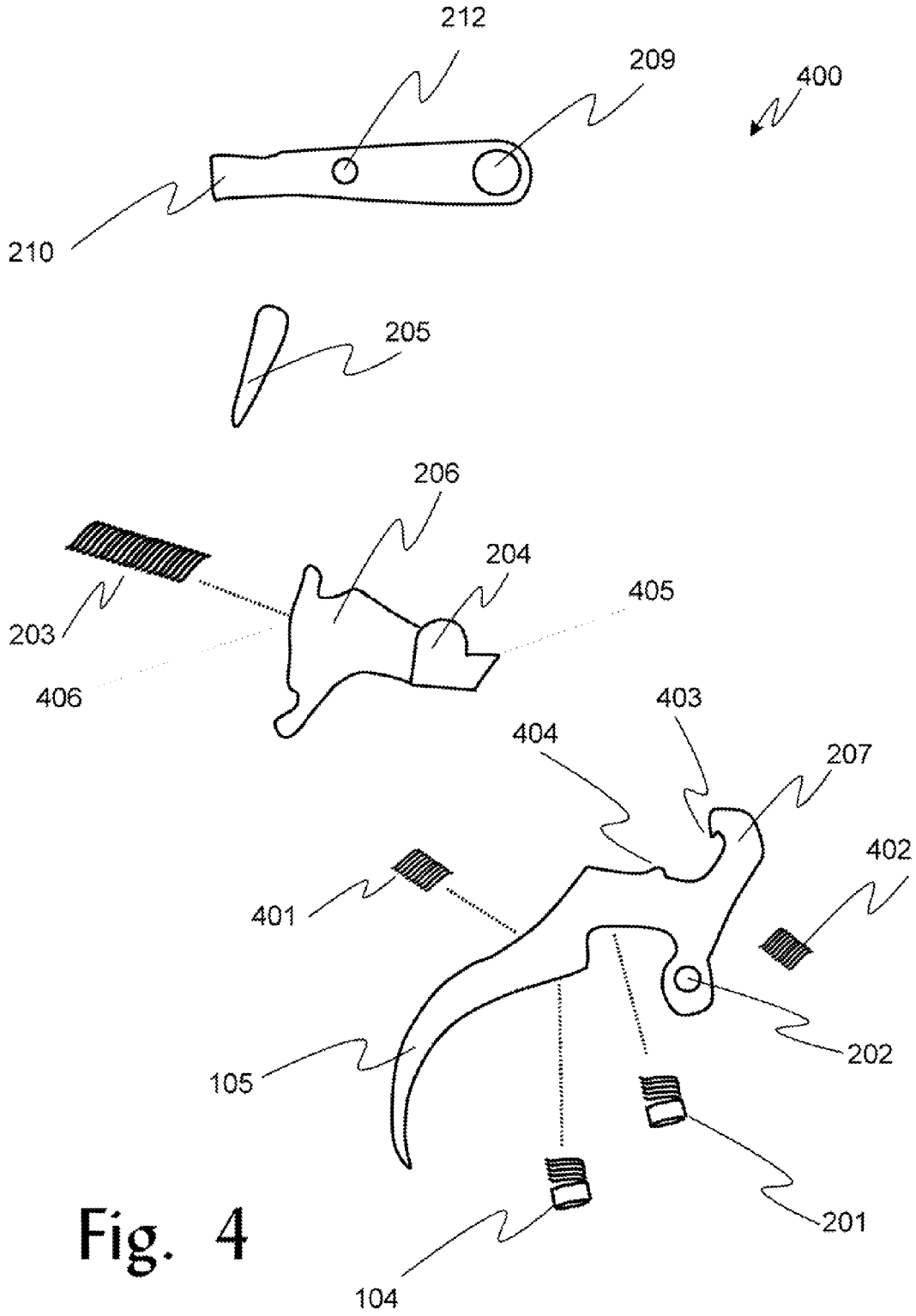
FIG. 4 provides an exploded view of the internal components, including a sear block, pivot drop, toggle sear, finger piece, and related biasing springs and hardware.

Turning now to FIGS. 2 and 4, and keeping in mind the structures already discussed, the trigger mechanism is shown in a fully assembled arrangement (200) in FIG. 2, except for the removal of the front cover to expose the components, with the details of the internal components being more readily visible in the exploded diagram (400) of FIG. 4. In this arrangement and in these positions, the components are in a "cocked" or "set" position which, when installed in a rifle receiver, would keep the rifle action in a cocked (ready to fire) position.

A sear block (210) is held on a pivot such as a hollow boss (399), through which an attachment means may pass, and around which the sear block is placed in a pivoting (209) arrangement. While the sear blocks movement is limited by island boss (212), which restricts the sear block movement via a backside counter bore (212'). The sear block serves to bear and transmit the load from a tensioned firing pin assembly (not shown) portion of a rifle action so that, when collapsed, such assembly may move forward (towards the right of this illustration) and cause firing of a rifle shell.

The pivot drop piece (205), extends through and operates in an angular channel orifice (305). The pivot drop piece serves to transmit the load from the sear block (210) to the toggle sear (206). The pivot drop piece is allowed free floating pivot in two planes so that when all three pieces collapse, the firing mechanism may move forward.

The toggle sear (206) is held on a pivot via radial socket (211). The toggle sear serves to support the pivot drop piece (205), the sear block (210), and to distribute and reduce force when engaged with a tensioned firing train. Collapse of the toggle sear happens as the toggle sear surface (405) becomes disengaged from the finger piece sear surface (403).

During return, a spring (203) residing in main spring pocket (406) formed in the toggle sear (206) forces the toggle sear to pivot forward and clockwise to reset once the trigger mechanism has collapsed (e.g. after firing). Springs (401 402) on the finger piece bias, it towards the toggle sear.

A toggle sear fly weight (204) affixed to the toggle sear (206) serves as an integral kinetic body of mass, providing both kinetic resistance of the mechanism during firing train advancement, as wells as additional kinetic force during return as the toggle sear makes contact with the finger piece reset projection (404).

The finger piece (105) is held on a second pivot (202), such as a second captive pivot, or alternatively, on a pin or on an island boss. The finger piece exhibits radial movement around the second pivot (202) such that it may contact a sear surface on the toggle sear (405) with its own corresponding sear surface (403) to maintain the assembly in the set position by preventing the collapse of the mechanism. When a force is applied to the trigger piece (105) in a leftward manner, the finger piece will rotate slightly clockwise, disengaging the sear surfaces (403, 405), and freeing the toggle sear (206) to rotate counterclockwise under the downward force of the pivot drop piece (205) and the sear block (210), the source of the downward force being the main spring of the rifle. As this motion occurs, the trigger mechanism collapses, allowing the sear block to drop clear of the firing pin of the rifle, leading to the firing of the rifle.

Figure 5A:
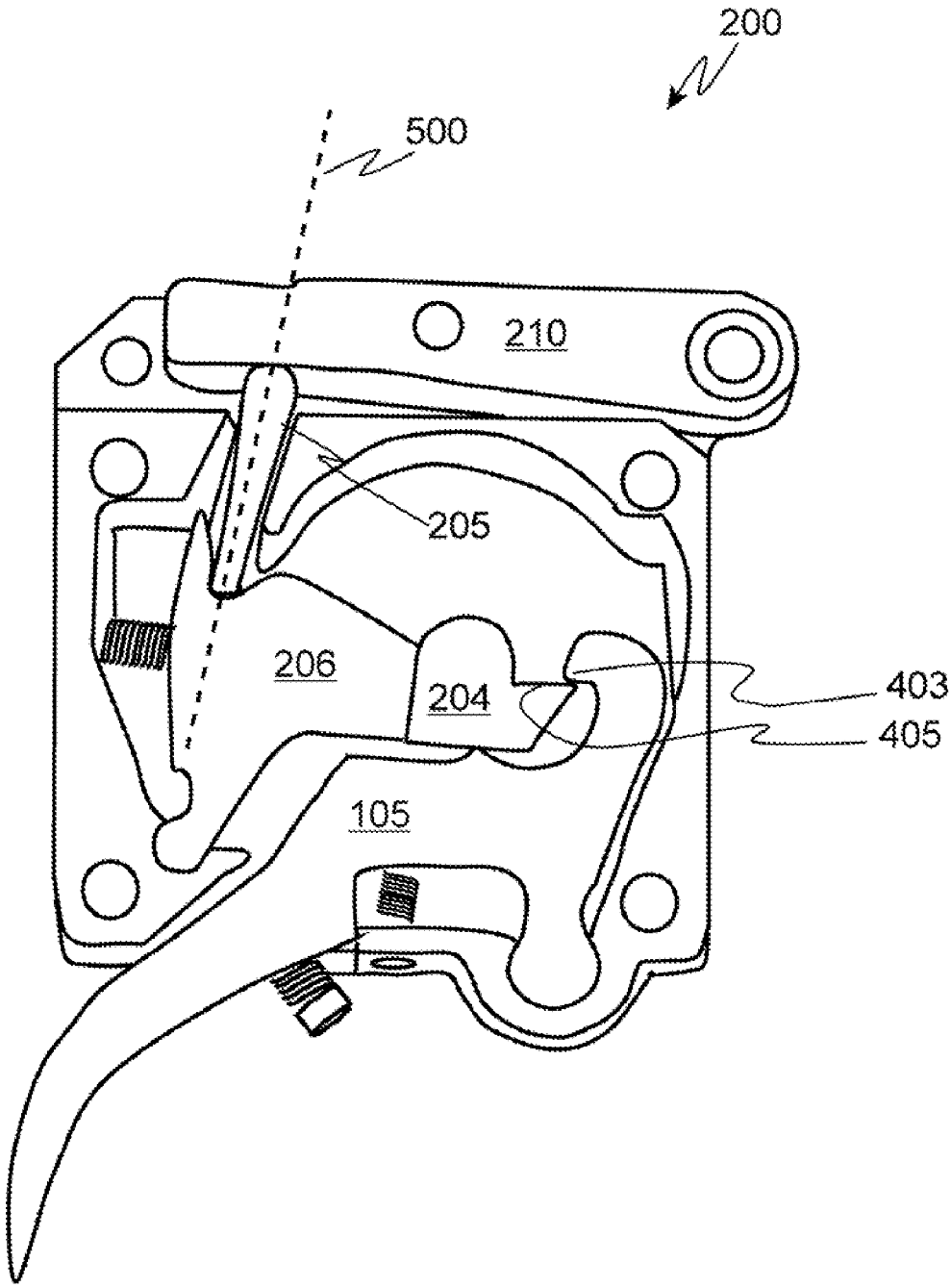
FIGS. 5*a* and 5*b* illustrate the over center geometry and operation of the collapsing of the trigger train.
Figure 5B:
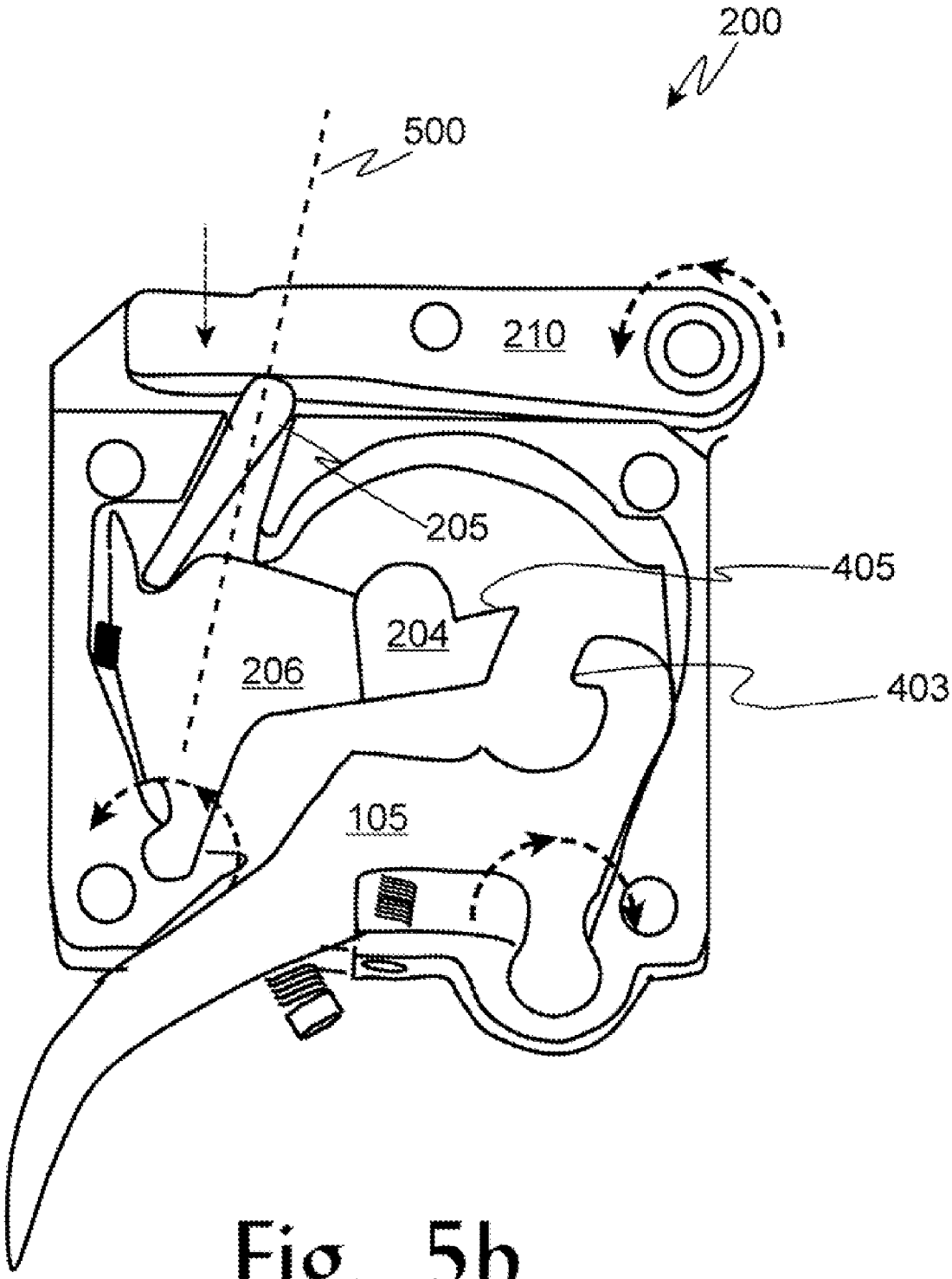

It is important to notice the particular geometry of the components in this position, as they provide an "over center" arrangement in conjunction with the kinetic energy controls. The center line (500) of FIG. 5*a* illustrates a stable condition of the components when the downward force from the rifle main spring is exerted through the sear block (210) and pivot drop piece (205) to the toggle sear (206) which is locked into position by the friction of the sear surfaces (403, 405). When a force equal to or greater than the sear friction force between the sear surfaces is applied in a leftward manner to the finger piece, the components rotate and release as shown in FIG. 5*b*, allowing the mechanism to collapse, and the sear block to drop.

Adjustment Mechanisms

Referring to the several figures and according to one or more optional embodiments, the adjustment screws (104, 201) control the finger piece limits of movement, and by controlling the amount of overlapping interface between the sear surfaces, also control the required amount of pressure or force to release the trigger.

The spring pocket (207) houses a spring which serves to aid in resetting the finger piece. The finger piece reset projection (404) makes contact with the toggle sear during trigger reset and serves as an integral reset feature for the finger piece.

Captive Pivots

Figure 6:
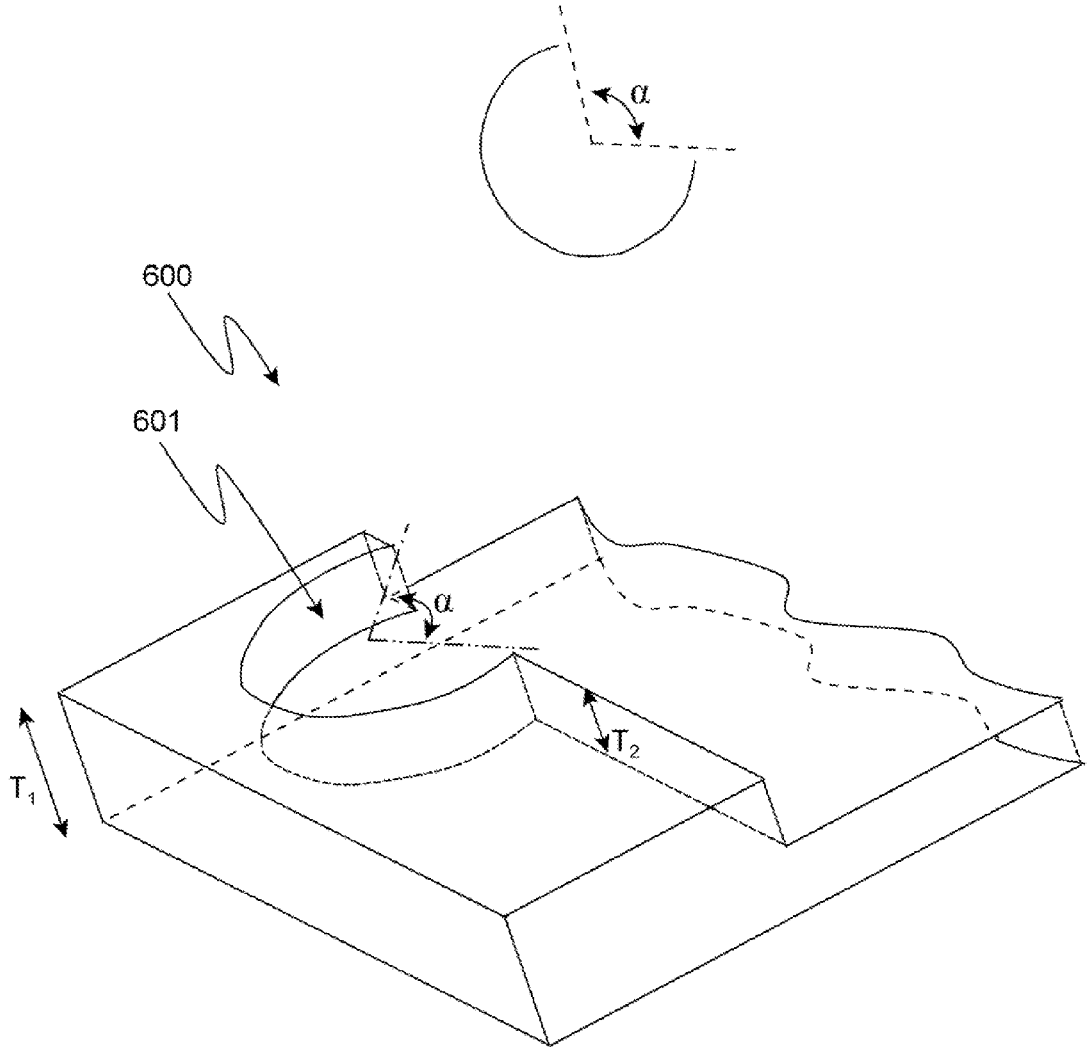
FIG. 6 shows a close-up view of a captive pivot assembly.

In at least one embodiment, the assembly is provided with one or more captive pivots, as shown in FIG. 2 (211, 202). FIG. 6 shows more detail of such a captive pivot, in which a solid portion of material (600), such as steel, is plunge cut (or molded or cast) to form a semi-circular indentation therein. In one embodiment, the solid portion of material has a thickness of $T_1$, but the socket portion (601) is formed by cutting into one surface a depth of T2, where $T_2<T_1$, thereby forming a bottom to the semi-circular socket receiver.

Here, we are using the term "semi-circular" not in its exact meaning of one-half a circle, because for the socket to actually capture the member disposed therein, the wall portion must form a slightly closed semi-circle, wherein the angle $\alpha$ formed from the center of the circle to the two ends of the walls is less than 180 degrees. Thus, a matching radial arm piece of slightly less diameter than the diameter of the socket portion may be freely dropped into the socket from the top, may be rotated about an approximate range of movement of $\alpha$, and is retained without a pin or boss from leaving the socket in any direction radial from the center axis of the socket. But, for cleaning or service, the captive part may be easily lifted up and out of the captive socket.

By employing one or more captive sockets, most of the traditional pins and bosses of such a trigger assembly are eliminated. This elimination reduces parts count, makes the mechanism easier and quicker to assemble thereby reducing production costs, increases reliability due to having fewer parts, and increases ease of cleaning by making assembly and disassembly easier, too.

Viewing Aperture

A sealed viewing aperture (101) is provided in the front cover, back cover, or both front and back covers, in one available embodiment. In our prototype, we have found that forming a circular hole in the cover, followed by producing a shallow groove around the inside of the hole creates a seat for receiving a clear acrylic window. The window is of similar circular diameter as the hole with a small tongue formed around the outer rim, suitable for press fitting into the shallow groove in the hole. This type of tongue-in-groove, snap fit is quick to assemble, yet provides a tight seal for rejecting contaminants. Other window mechanims may be used, as well, such as, but not limited to, glued in place windows.

Alternative Component Designs

It will be appreciated by those skilled in the art that the present invention is not limited to the specific embodiments illustrated and described herein, and that such illustrations and descriptions are only exemplary of available embodiments of the invention. The following claims should be consulted for determining the limitations of the present invention.

Some possible areas of alternative realization of the invention which would fall within the spirit and scope of the present invention are:

(a) the kinetic structure might be of a different size or shape or may not be integral to the toggle sear itself;
(b) the kinetic structure could be a floating member or of a different material with a heavier mass to reside in a cavity within the piece itself;
(c) the kinetic structure might be included in another internal piece using different trigger geometry;
(d) the integral reset projection on the finger piece could be employed on a number of current trigger designs;
(e) the reset projection might also be of a different size or shape or also not integral to the finger piece itself;
(f) the reset projection might also be positioned on another internal piece using the same or alternative trigger geometry;
(g) the enclosed nature of the trigger frame using all integral hinge pins or captive sockets could be alternatively employed on triggers with different geometry; and
(h) the window aperture feature of the trigger mechanism might be alternatively used on other trigger designs, in addition the size or shape might be changed and or a magnification lens might be added.

SUMMARY

The Kinetic Trigger achieves its results in the following ways. The Kinetic Trigger employs a unique design feature in that it uses a fly weight structure integral in the mass of the toggle sear to provide kinetic resistance during collapse. This resulting kinetic resistance dampens trigger component movements during collapse of the trigger mechanism allowing the cocking piece of the firing assembly to move forward untouched by the trigger sear block.

The Kinetic Trigger employs unique over center trip geometry for collapse of the trigger mechanism in which the toggle sear is held fixed on a radial hinge point. During collapse, subsequent forces are released in a radial direction counterclockwise from the hinge point. The mass of the toggle sear flyweight, aided by gravity and the specific arc of pivot, allow for resulting kinetic resistance to dampen component movement during collapse of the trigger mechanism.

Once collapsed, a rifle main spring forces the toggle sear in a clockwise motion to reset. In the process, the toggle sear flyweight assists the main spring bias in forcing the toggle sear to contact a strategically placed projection on the finger piece. Once contacted, the finger piece is also forced into reset position. This feature adds considerable reliability to the mechanism.

And, by incorporating a single cavity pin-less frame design, no separate pins or standoff hardware are required or used to actuate the mechanism. All hinge points in the Kinetic Trigger can be integral to the frame, which provides a trigger with very limited hardware making it more cost effective both to build and assemble.

Because the frame is a one piece cavity construction and does not employ side plates, this allows for a trigger mechanism that is shielded on all six sides from contaminants further increasing reliability.

And, in some embodiments, the Kinetic Trigger features a covered window aperture machined through both frame and cover plate. These apertures allow for sear engagement surfaces to be set using backlit magnification once the trigger is assembled. This is advantageous because setting sear engagement surfaces with consistency is difficult if those surfaces may not be viewed.

We claim:

1. A trigger mechanism for use in a firearm comprising:

a frame having a rear panel and one or more integral sides;

a front panel receivable and affixable to the frame;

a sear block positioned near a top of the frame, mounted about a first pivot to rise into a first position to engage a cocking piece or striker of a firearm to hold the cocking piece or striker in a cocked position, and having a second position pivotally rotated to release the cocking piece or striker, wherein the cocking piece or striker provides a downward force upon the sear block when in the first position of a tensioned firing train;

a pivot drop piece having a top end extending through an angular channel orifice in a top of the frame, the top end of the pivot drop piece engaging the sear block and operative to hold the sear block in the first position;

a toggle sear disposed within the frame having a notch receiving a bottom end of the pivot drop piece, mounted about a second pivot so as to support the first position of the sear block in an over center geometry when cocked, having a first sear surface;

a toggle sear fly weight member affixed to the toggle sear in a position storing kinetic energy during movement of the toggle sear, and providing kinetic resistance about the second pivot from a state of rest; and a finger piece mounted about a third pivot, having a finger actuating portion and a second sear surface, wherein the first and second sear surfaces mate to each other in a friction relationship to keep the sear block, pivot drop piece and toggle sear in a tensioned, over center, non-collapsed arrangement with the sear block in the first position, and wherein pressure equal to or greater than a threshold pressure upon the finger actuating portion overcomes the friction between the first and second sear surfaces, thereby rotating the finger piece about the third pivot to release the toggle sear to rotate about the second pivot as damped by a lack of kinetic inertia in the fly weight member, the rotation of the toggle sear leading to a collapse of the over center support of the sear block via the pivot drop piece, thereby releasing the cocking piece or striker, the fly weight member then storing kinetic inertia so as to continue providing rotational force about the second pivot such that the collapse completes and the sear block is dropped completely to the second position to allow travel of the cocking piece or striker unimpeded by friction with the sear block.

2. The trigger mechanism as set forth in claim 1 wherein the pivot drop piece is floating in the angular channel orifice.

3. The trigger mechanism as set forth in claim 1 wherein the fly weight is integrally formed with the toggle sear.

4. The trigger mechanism as set forth in claim 1 wherein the fly weight is separably provided with the toggle sear.

5. The trigger mechanism as set forth in claim 4 wherein the fly weight is exchangeable with alternate fly weights of different masses, thereby providing a degree of adjustment for the trigger mechanism operation.

6. The trigger mechanism as set forth in claim 1 further comprising a first spring biasing the toggle sear about the second pivot to provide a default position in which the first and second sear surfaces come into friction contact.

7. The trigger mechanism as set forth in claim 6 further comprising a second spring biasing the finger piece about the third pivot to provide a default position in which the first and second sear surfaces come into friction contact.

8. The trigger mechanism as set forth in claim 1 in which the frame is formed within a cavity of a portion of rigid material, the cavity being defined by a rear panel and a set of surrounding walls, the walls having the top orifice formed therein, and having a bottom orifice formed for passage of the finger actuating portion therethrough.

9. The trigger mechanism as set forth in claim 8 wherein the walls and rear panel are continuous material without seams or gaps, thereby providing a seal against contaminations when the front panel is affixed, except for the top and bottom orifices.

10. The trigger mechanism as set forth in claim 1 further comprising at least one sealed viewing aperture in the top panel or rear panel, having a transparent window disposed therein, and aligned with the engagement of the first and second sear surfaces.

11. The trigger mechanism as set forth in claim 1 wherein the second pivot comprises a captive socket structure.

12. The trigger mechanism as set forth in claim 1 wherein the third pivot comprises a captive socket structure.

13. The trigger mechanism as set forth in claim 1 in which the frame provides a cavity defined by a rear panel and a set of surrounding walls, the walls having the top orifice formed therein, and having a bottom orifice formed for passage of the finger actuating portion therethrough.

* * * * *